US007632071B2

(12) United States Patent
Charbonneau et al.

(10) Patent No.: US 7,632,071 B2
(45) Date of Patent: Dec. 15, 2009

(54) COOLED TURBINE BLADE

(75) Inventors: Robert Charbonneau, Meriden, CT (US); James Downs, Jupiter, FL (US); Shawn Gregg, Wethersfield, CT (US); Wesley Harris, Jupiter, FL (US); Natalya Khandros, Norfolk, CT (US); Jeffrey R. Levine, Wallingford, CT (US); Paul Orndoff, Palm Beach Gardens, FL (US); Steve Palmer, East Hartford, CT (US); Edward F. Pietraskiewicz, Southington, CT (US); Norm Roeloffs, Tequesta, FL (US); Richard Stockton, North Haven, CT (US); Wanda Widmer, Port Saint Lucie, FL (US); Dagny Williams, Rocky Hill, CT (US)

(73) Assignee: United Technologies Corporation, Hartford, CT (US)

( * ) Notice: Subject to any disclaimer, the term of this patent is extended or adjusted under 35 U.S.C. 154(b) by 55 days.

(21) Appl. No.: 11/303,593

(22) Filed: Dec. 15, 2005

(65) Prior Publication Data

US 2007/0140848 A1 Jun. 21, 2007

(51) Int. Cl.
*F01D 5/18* (2006.01)
*F01D 5/22* (2006.01)

(52) U.S. Cl. ..... 416/92; 416/193 A

(58) Field of Classification Search ..... 416/92
See application file for complete search history.

(56) References Cited

U.S. PATENT DOCUMENTS

| | | | | |
|---|---|---|---|---|
| 3,051,438 | A | 8/1962 | Royce | |
| 4,134,709 | A | 1/1979 | Eskesen | |
| 4,604,031 | A * | 8/1986 | Moss et al. | 416/92 |
| 4,820,123 | A | 4/1989 | Hall | |
| 4,940,388 | A * | 7/1990 | Lilleker et al. | 416/97 R |
| 5,700,131 | A | 12/1997 | Hall et al. | |
| 5,725,354 | A | 3/1998 | Wadia et al. | |
| 5,738,489 | A | 4/1998 | Lee | |
| 5,924,699 | A | 7/1999 | Airey et al. | |
| 6,033,181 | A | 3/2000 | Endres et al. | |
| 6,086,329 | A | 7/2000 | Tomita et al. | |
| 6,261,053 | B1 * | 7/2001 | Anderson et al. | 415/115 |
| 6,264,428 | B1 * | 7/2001 | Dailey et al. | 416/97 R |
| 6,347,923 | B1 | 2/2002 | Semmler et al. | |
| 6,390,775 | B1 * | 5/2002 | Paz | 416/193 A |

(Continued)

FOREIGN PATENT DOCUMENTS

EP 1128024 A2 8/2001

(Continued)

OTHER PUBLICATIONS

European Search Report dated Dec. 9, 2008.

*Primary Examiner*—Richard Edgar
(74) *Attorney, Agent, or Firm*—Bachman & LaPointe, P.C.

(57) ABSTRACT

A turbine engine component, such as a turbine blade, has an airfoil portion, a plurality of cooling passages within the airfoil portion with each of the cooling passages having an inlet for a cooling fluid. Each inlet has a flared bellmouth inlet portion. The turbine engine component may further have a dirt funnel at the tip of the airfoil portion, a platform with at least one beveled edge, and an undercut trailing edge slot.

15 Claims, 3 Drawing Sheets

U.S. PATENT DOCUMENTS

| | | | | |
|---|---|---|---|---|
| 6,565,318 | B1 * | 5/2003 | Tiemann | 416/97 R |
| 6,761,536 | B1 | 7/2004 | Bash et al. | |
| 2003/0219338 | A1 * | 11/2003 | Heyward et al. | 415/116 |
| 2005/0265841 | A1 * | 12/2005 | Magowan et al. | 416/97 R |

FOREIGN PATENT DOCUMENTS

| | | | |
|---|---|---|---|
| EP | 1234949 | A2 | 8/2002 |
| EP | 1365108 | A2 | 11/2003 |
| EP | 1544410 | A1 | 6/2005 |
| EP | 1605136 | A2 | 12/2005 |
| EP | 1605137 | A1 | 12/2005 |
| EP | 1674659 | A2 | 6/2006 |
| EP | 1793086 | A2 | 6/2007 |
| EP | 1793087 | A1 | 6/2007 |
| GB | 1350424 | A | 4/1974 |

* cited by examiner

COOLED TURBINE BLADE

BACKGROUND OF THE INVENTION (1) Field of the Invention

The present invention relates to a turbine engine component, such as a cooled turbine blade, for gas turbine engines.

(2) Prior Art

Cooled gas turbine blades are used to provide power in turbomachines. These components are subjected to the harsh environment immediately downstream of the combustor where fuel and air are mixed and burned in a constant pressure process. The turbine blades are well known to provide power by exerting a torque on a shaft which is rotating at high speed. As a result, the turbine blades are subjected to a myriad of mechanical stress factors resulting from the centrifugal forces applied to the part. In addition, the turbine blades are typically cooled using relatively cool air bled from the compressor. These cooling methods necessarily cause temperature gradients within the turbine blade, which lead to additional elements of thermal-mechanical stress within the structure.

An example of a prior art turbine blade 10 is shown in FIG. 1. As can be seen from the figure, the turbine blade has a number of cooling passages 12, 14, and 16 for cooling various portions of the airfoil portion of the blade 10.

Despite these turbine blades, there remains a need for improved turbine blades.

SUMMARY OF THE INVENTION

In accordance with the present invention, there is provided a gas turbine engine component containing specific elements for addressing design needs and, specifically, for addressing problem areas in past designs.

In accordance with the present invention, a turbine engine component broadly comprises an airfoil portion, a plurality of cooling passages within the airfoil portion with each of the cooling passages having an inlet for a cooling fluid. The inlet has a flared bellmouth inlet portion for reducing flow losses.

Other details of the cooled turbine blade of the present invention, as well as other objects and advantages attendant thereto, are set forth in the following detailed description and the accompany drawings, wherein like reference numerals depict like elements.

DETAILED DESCRIPTION OF THE PREFERRED EMBODIMENT(S)

The present invention relates to a new design for a component, such as a cooled turbine blade, to be used in gas turbine engines. The component of the present invention comprises a gas turbine airfoil containing unique internal and external geometries which contribute to the aim of providing long-term operation. The turbine component contains unique features to enhance the overall performance of the turbine blade.

Figure 2:
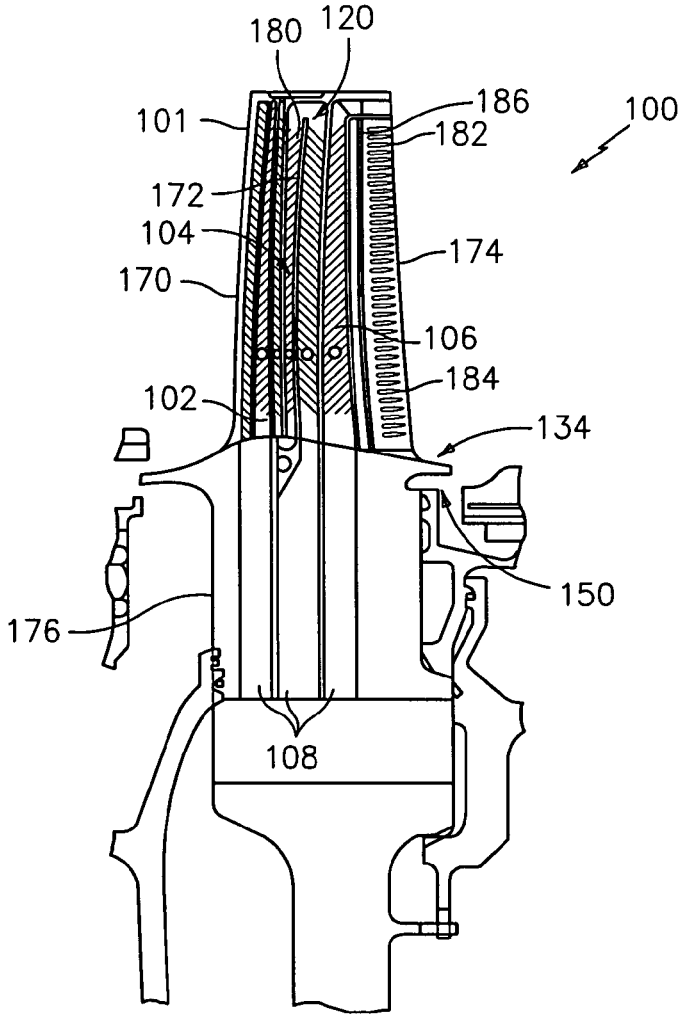
FIG. 2 illustrates a turbine blade in accordance with the present invention.

Referring now to FIG. 2, there is shown a turbine blade 100 in accordance with the present invention. The turbine blade 100 is provided with an airfoil portion 101, preferably having three independent cooling circuits 102, 104, and 106 to address the separate needs of the airfoil portion leading edge 170, the main airfoil body 172, and the airfoil trailing edge region 174. Each of the cooling circuits 102, 104, and 106 may be provided with a plurality of trip strips or other devices 180 for creating turbulence in a cooling fluid flowing through the circuits 102, 104, and 106 to enhance the heat transfer within the cooling circuits. The trailing edge 174 of the airfoil portion 101 may have a plurality of outlets 182 formed by tear drop shaped ferrules 184. If desired, a plurality of pedestals 186 may be provided to properly align the cooling air flow prior to the cooling air flowing out the outlets 182. The turbine blade 100 also preferably has an integrally formed platform 134 and an integrally formed attachment portion 176.

The turbine component may be formed from any suitable metallic material known in the art.

With regard to air inlet systems for the cooling passages in prior art turbine blades, the typical method for inserting cooling air into the rotating gas turbine blade causes pressure losses which limit the capability of the cooling air to adequately cool the part. Typically, cooling air is caused to flow into the turbine blade from a slot in the disk, which slot is located below the blade attachment. The inlets to these slots are typically sharp-edged. This causes the flow to separate from the edge and to reattach to the surface some distance downstream of the inlet. This action causes a pressure loss in the flow stream entering the part. Further, channels extend through the airfoil attachment portion to connect the cooling air inlets with cooling passages at the root of the airfoil. Typically, these channels neck down to form a minimum area through the region bounded by the bottom root serration. Downstream of this region, the cooling passages are commonly allowed to expand rapidly to allow material to be removed from the turbine blade. This expansion promotes additional pressure loss by further flow separation action.

Figure 3:
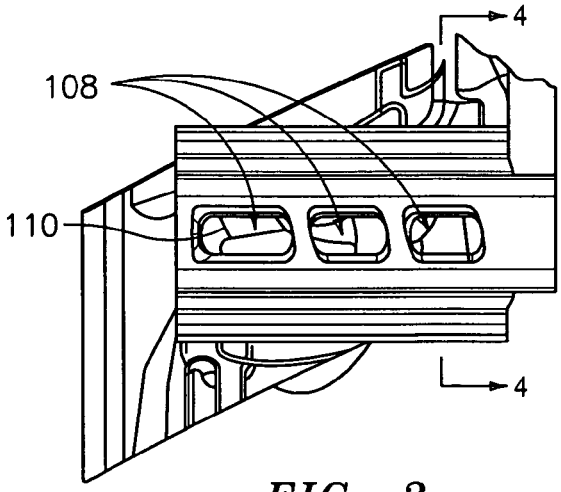
FIG. 3 illustrates a low-loss cooling air inlet used in the turbine blade of FIG. 2.
Figure 4:
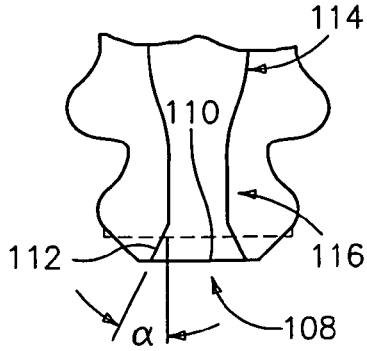
FIG. 4 is a sectional view taken along lines 4-4 in FIG. 3.

To avoid these problems, the turbine blade 100 of the present invention preferably includes a low-loss cooling air inlet system 108 for each of the cooling circuits 102, 104, and 106. Each low-loss cooling air inlet system 108 reduces coolant pressure loss at the inlet. As shown in FIGS. 3 and 4, the low-loss cooling air inlet system 108 has a plurality of inlets 110. Each inlet 110 has a flared portion 112 to guide flow into the inlet. In addition, each inlet 110 has a smooth transition 114 in a region downstream of the minimum area 116 to allow the cooling air to diffuse more efficiently. Flow and pressure loss testing for this arrangement has shown marked improvement over the inlet configurations used in the prior art. In a preferred embodiment, a flare angle $\alpha$ of 25 degrees is used to provide a so-called "bellmouth" effect by opening the inlet. However, other combinations of angle and increased inlet area can provide the same effect. A useful range of flare angles is from 10 to 35 degrees. The main purpose of the flare is to reduce the velocity of air at the entrance of the coolant passage. This is facilitated by making the inlet larger, which is accomplished by a larger flare angle. The inlet loss is reduced because flow is not so likely to separate from the edges of the inlet because the flow does not have to turn into the inlet as quickly and it does not need to accelerate so quickly. A limitation on the total amount of area that can be provided is the width of the blade bottom. The inlet of the flared region cannot be larger than the blade bottom. The flared region causes the flow to accelerate to the minimum area in a more controlled fashion. If a very steep flare angle was used, the flow would need to accelerate very quickly to the minimum area. At that point, it might have a tendency to separate if the rate of contraction were to change suddenly. The idea is to make flow changes gradual through the region. Alternatively, a radius, or a combination of radii, may be used to form the bellmouth surface 112.

Figure 1:
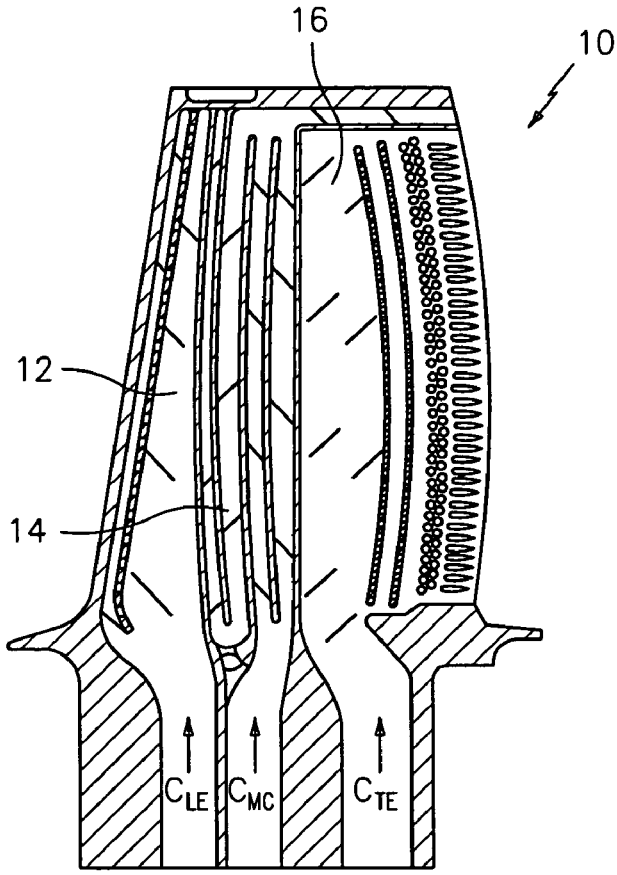
FIG. 1 (PRIOR ART)
FIG. 1 illustrates a prior art turbine blade.
Figure 5:
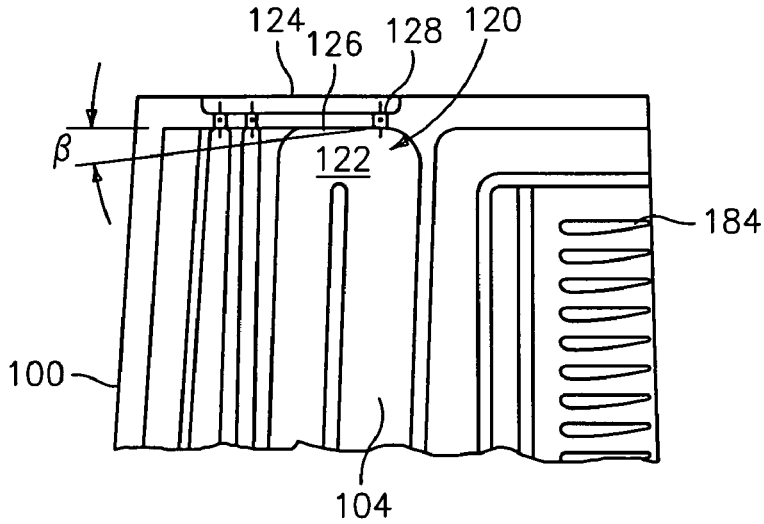
FIG. 5 illustrates a dirt funnel positioned at the tip of the airfoil portion of the turbine blade of FIG. 2.

Referring now to FIG. 5, turbine blade 100 also preferably has a dirt funnel 120 located in the serpentine tip turn 122 of the cooling air circuit 104. The purpose of the funnel 120 is to promote removal of dust and dirt from the blade 100 and to reduce or eliminate the build-up of such materials at the tip 124 of the blade 100. FIG. 5 illustrates the dirt funnel 120. The tip turn surface 126 may be angled at angle β, such as at about 15 degrees, relative to the tip 124 to promote particulate movement toward a tip dirt purge hole 128 where it can be discharged from the blade 100. These unwanted materials tend to be centrifuged to the tip 124 of the blade 100 where they accumulate over time. Although the angled surface 126 represents one possible embodiment, other angles and/or structured surfaces may be used to provide the same effect.

Figure 6:
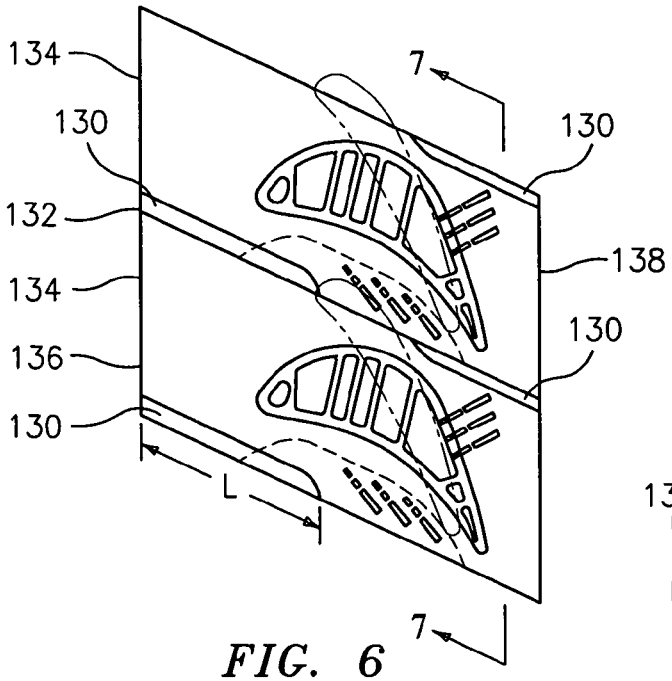
FIG. 6 illustrates a beveled platform edge used with the turbine blade of FIG. 2.
Figure 7:
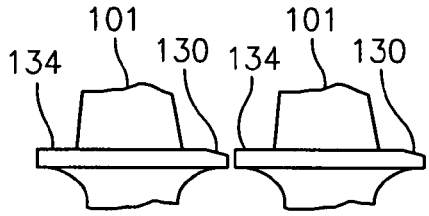
FIG. 7 is a sectional view taken along lines 7-7 in FIG. 6.

Referring now to FIGS. 6 and 7, the turbine blade 100 may further have beveled edges 130. Prior art turbine blades include platform edges that are line-on-line to transition from one platform surface to another and to provide a smooth flowpath surface. However, manufacturing tolerances can cause the platform surfaces to be misaligned in the final assembly. These tolerances may occur in both the casting and machining processes required to fabricate the parts. Misalignment of the platform surfaces can result in either a step-up to the flow in the hot gas flowpath, or a step-down such as a waterfall. The step-up can be particularly damaging from a thermal performance perspective because the hot gas is then permitted to impinge on the feature and the heat transfer rates can then be elevated to rather high levels. In addition, the step also trips the flow and increases turbulence causing increased heat transfer rates downstream of the trip. The performance is not nearly as sensitive in the event of a step-down in the flowpath.

In accordance with the present invention, the platforms 134 are each provided with a beveled platform edge 130. The purpose of the beveled platform edges 130, therefore, is to provide a margin in the design of the turbine blade 100 so that a flowpath step-up does not occur. The beveled platform edges 130 can be used wherever flow crosses a platform gap 132 between two adjacent platforms 134 of two adjacent turbine blades 100. The beveled platform edges 130 may be placed anywhere along the edges of the platforms 134; however, typical locations are at the front 136 and rear 138 of the platform 134. The beveled platform edges 130 may be located on the underside or the top side of the platform 134. The beveled edges 130 may have any desired extent L along the flowpath.

Figure 8:
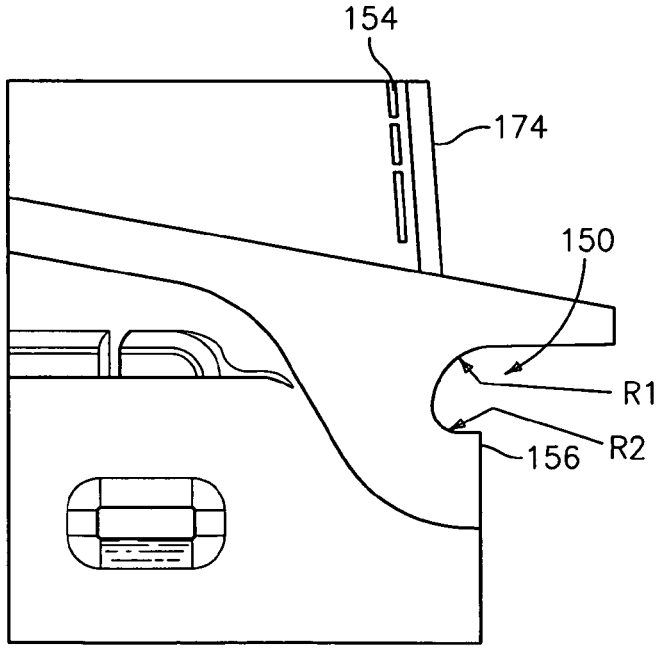
FIG. 8 illustrates a shaped-slot trailing edge undercut used with the turbine blade of FIG. 2.

Still further, the turbine blade 100 may be provided with a shaped-slot undercut 150 which extends beneath the blade trailing edge 174. Prior art blades includes those that are not undercut, those that are fully undercut (no attachment features underneath the airfoil trailing edge), and those that are undercut with a simple-radiused slot. The purpose of the shaped-slot undercut 150 of the present invention is to provide an optimized slot undercut configuration based on engineered radii at the bottom of the slot. Engineering of the slot profile 154 has been shown to optimize the structural design to the lowest level of concentrated stress. An example of such an engineered slot profile is shown in FIG. 8. As shown therein, two distinct radii R1 and R2 are used at the bottom of the slot 156 to optimize the local stress field by controlling the stress field and concentration factors around the slot. The optimization parameters are a function of many variables including overall P/A stress, bending stress, temperature distribution within the part (i.e. thermally-induced stress), as well as many other variables. Since these variables differ from one application to another, the optimization parameters will vary. R2 forms the lowermost portion of the slot 150 and R1 forms the region adjacent the lowermost portion of the slot 150. Generally, R1 is greater than R2. For example, R1 may be 0.090 inches and R2 may be 0.040 inches.

While the present invention has been described in the context of a turbine blade, the various features described herein, individually and collectively, could be used on other turbine engine components.

It is apparent that there has been provided in accordance with the present invention a cooled turbine blade which fully satisfies the objects, means, and advantages set forth hereinbefore. While the present invention has been described in the context of specific embodiments thereof, unforeseen alternatives, modifications, and variations may become apparent to those skilled in the art having read the foregoing description. Accordingly, it is intended to embrace those alternatives, modifications, and variations as fall within the broad scope of the appended claims.

What is claimed is:

1. A turbine engine component comprising:

an airfoil portion;

a plurality of cooling passages within the airfoil portion;

said cooling passages including a first cooling passage for cooling a leading edge portion of said airfoil portion, a second cooling passage for cooling a main body portion of said airfoil portion, and a third cooling passage for cooling a trailing edge portion of said airfoil portion;

said first cooling passage receiving cooling fluid from only a first inlet having a flared bellmouth inlet portion;

said second cooling passage being independent of said first cooling passage and receiving said cooling fluid from only a second inlet having a flared bellmouth inlet portion;

said third cooling passage being independent of said second cooling passage and receiving said cooling fluid from only a third inlet having a flared bellmouth inlet portion and said third cooling passage having a plurality of outlets for cooling a trailing edge of said airfoil portion;

said second cooling passage having a serpentine tip turn and a dirt funnel located in the serpentine tip turn;

a platform and said platform having a plurality of beveled edges to avoid a flowpath step-up;

each said beveled edge being located where flow crosses a platform gap with an adjacent platform of an adjacent turbine component;

a first one of said beveled edges being located along a first side of said platform and a second one of said beveled edges being located along a second side of said platform;

said airfoil portion having a trailing edge and an undercut extending beneath a portion of said trailing edge; and said undercut being positioned beneath said platform.

2. The turbine engine component of claim 1, wherein each said inlet further has a minimum area adjacent said flared bellmouth inlet portion and a smooth transition region downstream of and adjacent said minimum area to allow cooling air to diffuse.

3. The turbine engine component of claim 1, wherein each said flared bellmouth inlet portion comprises a pair of flared walls which extend along two opposed surfaces of said inlet.

4. The turbine engine component according to claim 1, wherein said undercut is slot shaped.

5. The turbine engine component according to claim 1, wherein said component comprises a turbine blade.

6. The turbine engine component of claim 1, wherein said airfoil portion has a tip with an exterior surface, wherein said second cooling passage has a tip dirt purge hole, wherein said serpentine tip turn has two arcuate surfaces and a surface positioned intermediate said arcuate surfaces, and wherein said surface positioned intermediate said arcuate surfaces is angled with respect to said exterior surface of said tip so as to promote particulate movement toward the tip dirt purge hole.

7. The turbine engine component according to claim 6, wherein said serpentine tip turn surface is at an angle of 15 degrees with respect to said tip.

8. The turbine engine component of claim 6, wherein each said inlet further has a minimum area adjacent said flared bellmouth inlet portion and a smooth transition region adjacent to and downstream of said minimum area and wherein each said flared bellmouth inlet portion comprises a pair of flared walls which extend along two opposed surfaces of said inlet.

9. The turbine engine component of claim 6, further comprising said first one of said beveled edges being located at a front of the platform and said second one of said beveled edges being located at a rear of the platform.

10. The turbine engine component of claim 6, wherein said undercut has a profile with a first radii used at a first portion and a second radii used at a second portion and wherein said second radii forms a lowermost portion of the profile and said first radii forms a region adjacent said lowermost portion.

11. The turbine engine component of claim 10, wherein said first radii is larger than said second radii.

12. The turbine engine component of claim 1, wherein each said bellmouth inlet has a flare angle in the range of from 10 to 35 degrees.

13. The turbine engine component of claim 1, wherein said first one of beveled edges is located adjacent a leading edge of said platform and said second one of said beveled edges is located adjacent a trailing edge of said platform.

14. The turbine engine component of claim 1, wherein at least one of said beveled edges is located on an underside of the platform.

15. The turbine engine component of claim 1, wherein at least one of said beveled edges is located on a top side of the platform.

* * * * *